US011393602B2

(12) United States Patent
Tignat et al.

(10) Patent No.: US 11,393,602 B2
(45) Date of Patent: Jul. 19, 2022

(54) PACKAGING FOR TRANSPORTING AND/OR STORING RADIOACTIVE MATERIALS HAVING A DESIGN THAT FACILITATES THE HANDLING OF THE MASS OF RADIOACTIVE MATERIALS

(71) Applicant: Orano Nuclear Packages and Services, Montigny le Bretonneux (FR)

(72) Inventors: Aude Tignat, Guyancourt (FR); Benjamin Kerr, Paris (FR)

( * ) Notice: Subject to any disclaimer, the term of this patent is extended or adjusted under 35 U.S.C. 154(b) by 0 days.

(21) Appl. No.: 17/251,950

(22) PCT Filed: Jun. 14, 2019

(86) PCT No.: PCT/FR2019/051454

§ 371 (c)(1),
(2) Date: Dec. 14, 2020

(87) PCT Pub. No.: WO2019/239078

PCT Pub. Date: Dec. 19, 2019

(65) Prior Publication Data

US 2021/0313083 A1 Oct. 7, 2021

(30) Foreign Application Priority Data

Jun. 15, 2018 (FR) ..... 1855265

(51) Int. Cl.
*G21F 5/08* (2006.01)
*G21F 5/12* (2006.01)
*G21F 1/08* (2006.01)

(52) U.S. Cl.
CPC ..... *G21F 5/08* (2013.01); *G21F 1/085* (2013.01); *G21F 5/12* (2013.01)

(58) Field of Classification Search
CPC ..... G21F 5/08; G21F 1/085; G21F 5/12
(Continued)

(56) References Cited

U.S. PATENT DOCUMENTS 5,615,794 A 4/1997 Murray, Jr.
2010/0284506 A1* 11/2010 Singh ..... G21F 5/005 29/428

(Continued)

FOREIGN PATENT DOCUMENTS

FR 1553725 A 1/1969
WO 02/39461 A1 5/2002

OTHER PUBLICATIONS

Search Report issued in French Patent Application No. 1855265 dated May 3, 2019.

(Continued)

*Primary Examiner* — Nicole M Ippolito
(74) *Attorney, Agent, or Firm* — Pearne & Gordon LLP

(57) ABSTRACT

A packaging for transporting and/or storing radioactive materials, the lateral body of which has a thickness change zone defining a transition surface, and including a portion of reduced thickness extending from the transition surface towards a first axial end of the lateral body, this portion of reduced thickness including an inner surface laterally delimiting a recessed zone of the lateral body, also delimited axially by the transition surface. Moreover, the packaging includes a portion reconstituting the lateral body extending around the longitudinal axis, arranged removably in the recessed zone, and having an inner surface that laterally delimits a portion of the housing cavity intended to receive the mass of radioactive materials.

14 Claims, 5 Drawing Sheets

(58) Field of Classification Search
USPC ..... 250/505.1, 506.1, 507.1, 515.1, 516.1, 250/517.1, 518.1, 519.1
See application file for complete search history.

(56) References Cited

U.S. PATENT DOCUMENTS

2019/0103197 A1* 4/2019 Singh ..... G21F 5/10
2021/0225539 A1* 7/2021 Singh ..... G21F 5/005

OTHER PUBLICATIONS

International Search Report for Application No. PCT/FR2019/051454 dated Sep. 26, 2019.
Written Opinion for PCT/FR2019/051454 dated Sep. 26, 2019.
International Preliminary Report on Patentability for Application No. PCT/FR2019/051454 dated Sep. 18, 2020.

* cited by examiner

PACKAGING FOR TRANSPORTING AND/OR STORING RADIOACTIVE MATERIALS HAVING A DESIGN THAT FACILITATES THE HANDLING OF THE MASS OF RADIOACTIVE MATERIALS

This is the National Stage of PCT international application PCT/FR2019/051454, filed on Jun. 14, 2019 entitled "PACKAGING FOR TRANSPORTING AND/OR STORING RADIOACTIVE MATERIALS HAVING A DESIGN THAT FACILITATES THE HANDLING OF THE MASS OF RADIOACTIVE MATERIALS", which claims the priority of French Patent Application No. 1855265 filed Jun. 15, 2018, both of which are incorporated herein by reference in their entirety.

TECHNICAL FIELD

The present invention relates to the field of packaging for transporting and/or storing radioactive materials, for example radioactive waste placed in barrels, or nuclear-fuel assemblies.

PRIOR ART

From the prior art, numerous designs for packaging for transporting and/or storing radioactive materials are known. Generally, the packaging has a housing cavity receiving a mass of radioactive materials, this cavity being defined by a lateral body, a bottom, and a lid mounted removably on the lateral body.

To extract the mass of radioactive materials, the lid is first of all removed from the main body. Next the mass is gripped by a handling device in order to be extracted from the housing cavity. In order to ensure such extraction, the handling device must be connected to the mass of radioactive materials, for example at a head end of this mass.

Nevertheless, in some cases, the mass requires being gripped at the lateral face thereof by the handling device. A radial clearance is then generally provided between this mass and the internal surface of the lateral body delimiting the housing cavity. Thus the handling device can be introduced axially into this radial clearance, in order to be connected to the lateral face of the mass of radioactive materials. This radial clearance does however lead to oversizing the packaging, with negative consequences in terms of weight, cost and bulk.

DESCRIPTION OF THE INVENTION

To respond to the problem identified below, the object of the invention is packaging for transporting and/or storing radioactive materials according to the features of claim 1.

Thus, when the lateral-body reconstitution part is removed, the hollowed-out zone procures lateral access to the mass of radioactive materials, easily enabling it to be gripped laterally. This is because the hollowed-out zone allows the introduction of a handling device between the internal surface of the reduced-thickness part of the lateral body, and the mass of radioactive materials.

This facilitated gripping is advantageously obtained without increasing the width of the lateral body, which guarantees control of the costs, of the total weight of the packaging, and the bulk thereof.

Furthermore, the lateral-body reconstitution part makes it possible to reconstitute the thickness of the lateral body locally at the reduced-thickness part thereof, leading to an absence of leakage of shielding.

Finally, at least part of the lid, and preferably the lid in its entirety, can be arranged in the hollowed-out zone of the lateral body defined laterally by the reduced-thickness part of this lateral body. The mechanical strength of the packaging is therefore satisfactory in the event of lateral or oblique falling, since the lid is protected by the lateral body.

The invention moreover has at least one of the following optional features, taken in isolation or in combination.

The reconstitution part extends in an uninterrupted fashion all around the longitudinal axis, in order thus to form a closed structure over 360°, such as for example an annular structure, of constant or variable thickness. Preferably, the reconstitution part is such that the assembly that it forms with the lateral body has constant thickness, in order to procure homogeneous and satisfactory shielding performance. This structure closed over 360° may be produced in a single piece, or by the succession of angular sectors arranged end to end, without clearance.

Alternatively, the reconstitution part extends over only an angular sector of less than 360°, and in this case several reconstitution portions can be provided within the packaging, spaced apart angularly from one another.

The lateral-body reconstitution part:

a) is independent of the lateral body and of the lid; and b) forms an integral part of the lid, which also comprises a main part for axial closing off of the housing cavity defining an axial end surface of this cavity, the lateral-body reconstitution part being arranged projecting axially in the direction of the bottom from the axial-end surface; or c) is formed by combining a primary and a secondary lateral-body reconstitution portion, the primary portion forming an integral part of the lid, which also comprises a main part for axial closing off of the housing cavity defining an axial-end surface of this cavity, the primary portion including firstly a lateral wall forming the internal surface and arranged projecting axially in the direction of the bottom from the axial end surface, and secondly a fixing flange arranged at an axial end of the lateral wall and intended to be in abutment against the transition surface, the secondary portion being independent of the lateral body and of the lid, and arranged radially between the internal surface of the reduced-thickness part of the lateral body, and the assembly formed by the lateral wall of the primary portion of the lid and the main part of this lid.

The packaging comprises means for fixing the lid on the lateral body, the fixing means passing through the lateral-body reconstitution part as well as the transition surface of the lateral packaging body. This embodiment is preferentially adopted in case b), when the lateral-body reconstitution part is integrated in the lid.

In case c), these fixing means preferentially pass through the fixing flange of the primary portion of the lateral-body reconstitution part. The length thereof may thus be advantageously reduced, passing only through this fixing flange, and not the secondary portion of the reconstitution part.

Alternatively, the fixing means could cooperate with the first axial end of the lateral body, without departing from the scope of the invention. This alternative embodiment is then preferred when the lateral-body reconstitution part is independent of the lateral body and of the lid, the reconstitution part being in this case able to be held axially without clearance or with axial clearance between the lid and the transition surface.

A sealing system is gripped axially between the transition surface of the lateral body and an axial end of the lateral-body reconstitution part. This embodiment is preferentially adopted in the aforementioned cases b) and c).

Here again, the sealing system could alternatively be gripped axially between the first axial end of the lateral body and a portion of the lid covering this end, without departing from the scope of the invention. This alternative embodiment is then preferred in case a), when the lateral-body reconstitution part is independent of the lateral body and of the lid.

The lid is entirely covered laterally by the reduced-thickness part of the lateral body, in order to reinforce the mechanical strength in the event of a fall. Nevertheless, part of this lid could be arranged externally with respect to the lateral body, in the axial direction, and this without departing from the scope of the invention.

The packaging further includes an additional lid fixed to the lateral body.

The packaging further includes an impact-damping cap covering at least part of the lid, as well as the first axial end of the lateral body.

The internal surface of the lateral-body reconstitution part laterally delimits an axial section of the lateral cavity, the axial section extending over an axial length greater than or equal to 50 mm. Preferentially, the length of this axial section corresponding for example to 20% of the total axial length of the housing cavity, and at a maximum to 50% of this total axial length of the housing cavity.

The transition surface of the lateral body forms an internal shoulder. Alternatively, this surface could take other forms providing the transition of thickness in the lateral body, such as an oblique surface, a stepped surface, etc.

An object of the invention is a parcel comprising packaging as described above, loaded with a mass of radioactive materials housed in the housing cavity, the mass of radioactive materials, preferably in the form of a barrel, being located at the part laterally facing the lateral-body reconstitution part.

Another object of the invention is a discharging method according to claim 12.

Other advantages and features of the invention will emerge in the following non-limitative detailed description.

BRIEF DESCRIPTION OF THE DRAWINGS

This description will be given with regard to the accompanying drawings, among which.

DETAILED DISCLOSURE OF PREFERRED EMBODIMENTS

Figure 1:
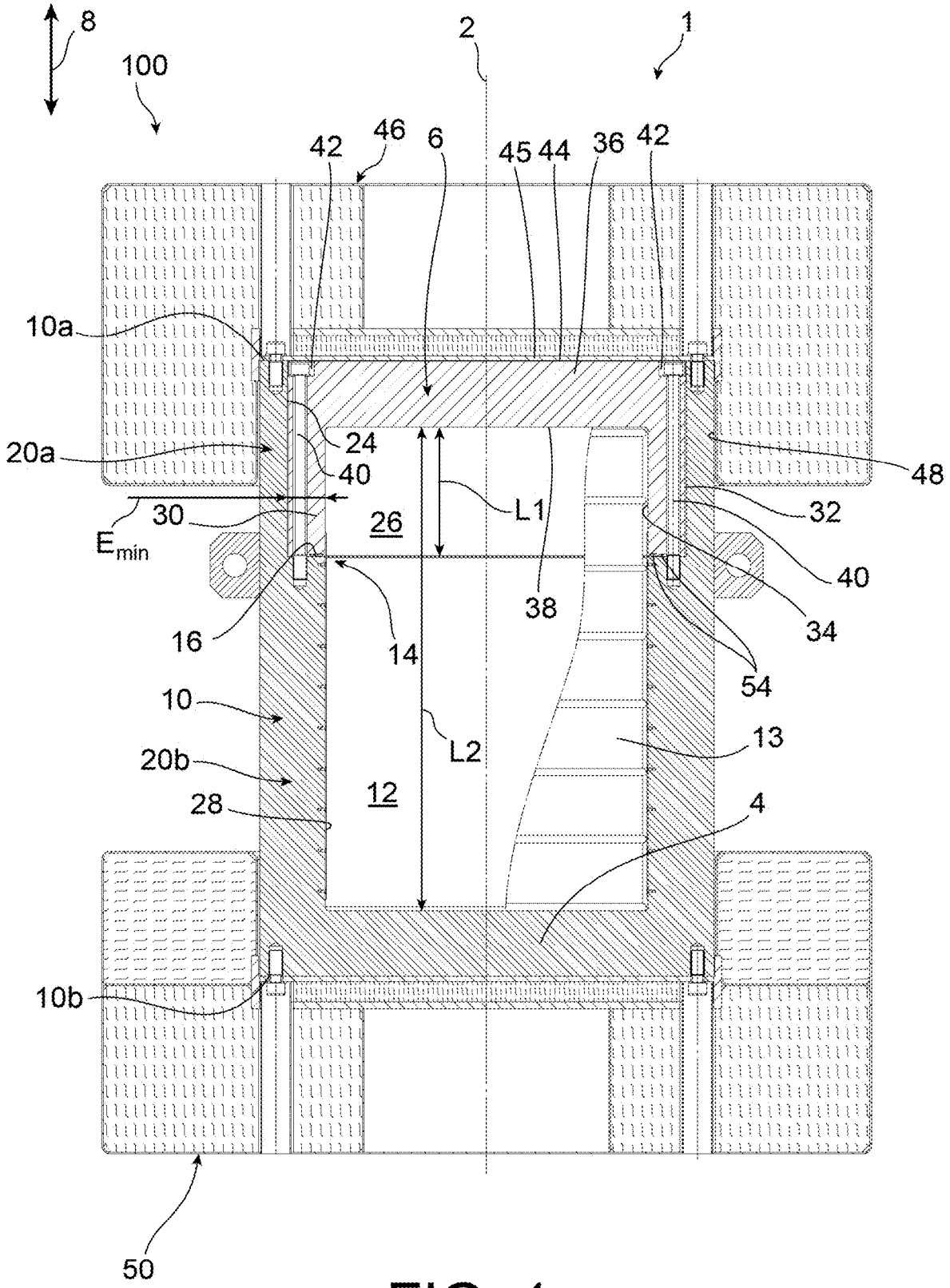
FIG. 1 shows a view in longitudinal axial section of packaging for storing and/or transporting radioactive materials, according to a preferred embodiment of the present invention.
Figure 2:
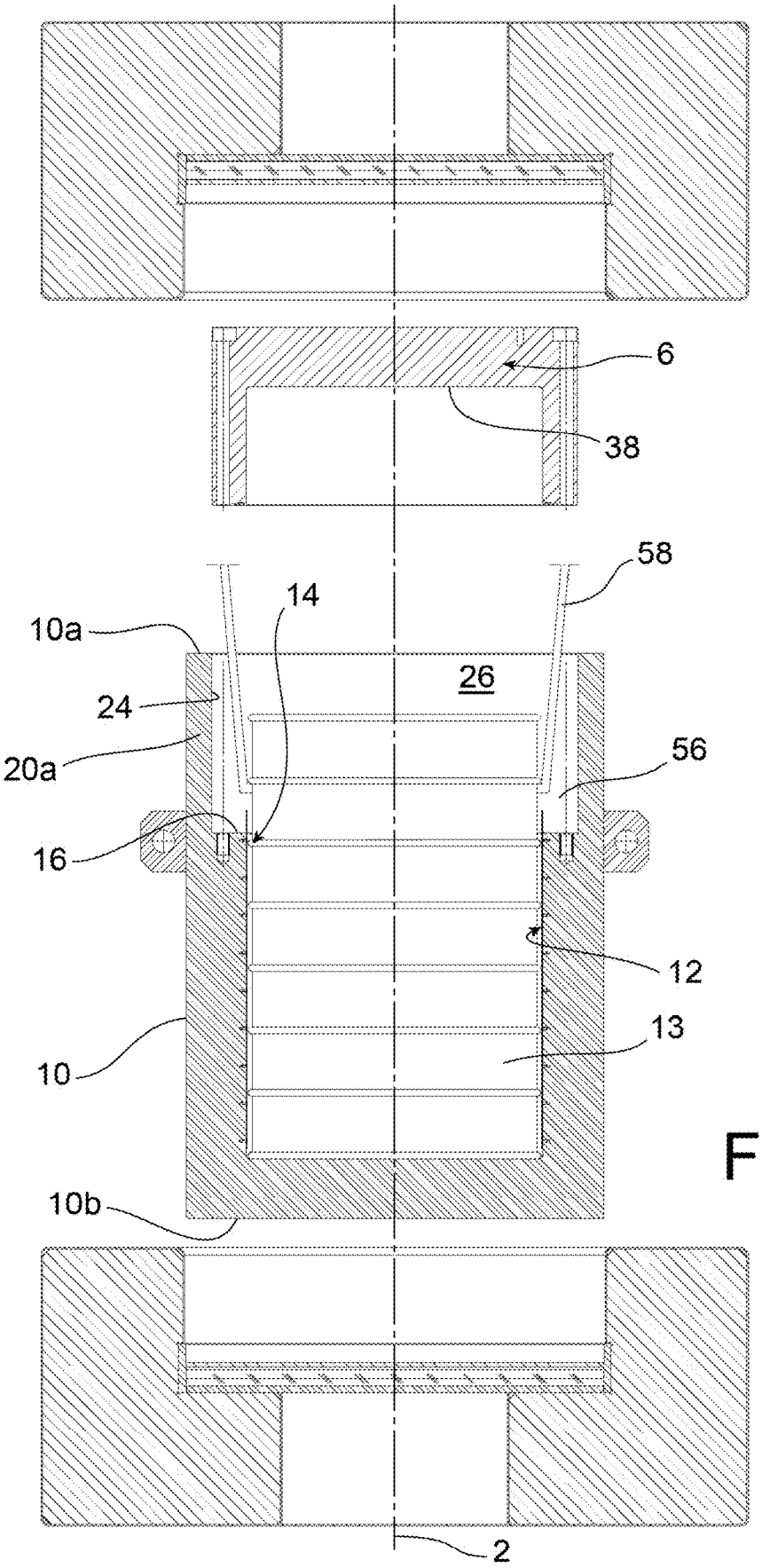
FIG. 2 shows a view similar to the one in the previous figure, in an exploded view.
Figure 3:
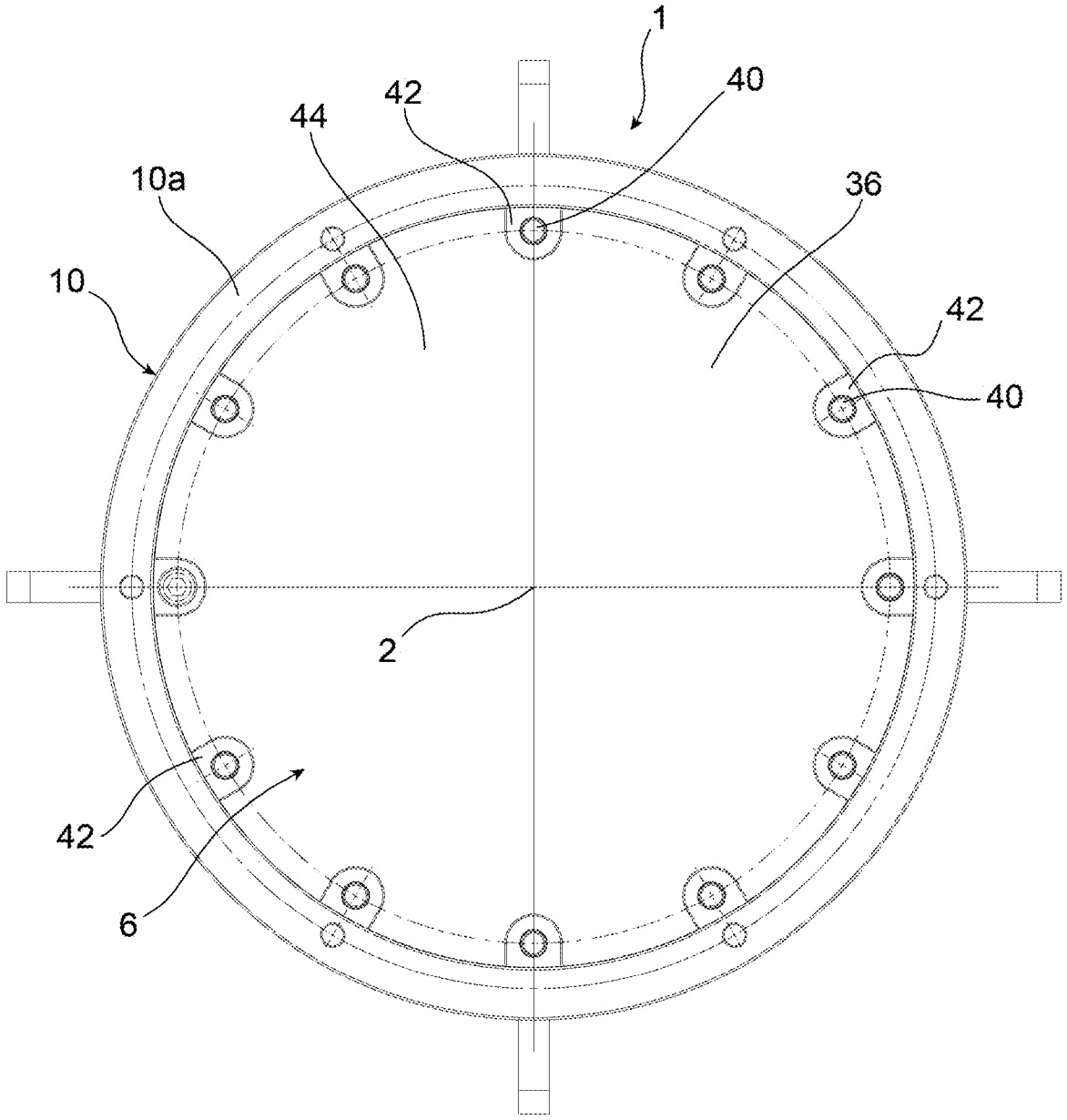
FIG. 3 is a plan view of the packaging shown in the preceding figures, with the packaging shown without the head damping cap thereof.

With reference first of all to FIGS. 1 to 3, packaging 1 for storing and/or transporting radioactive materials is shown, according to a preferred embodiment of the invention.

This packaging 1 is shown in the vertical storage position, wherein the longitudinal axis 2 thereof is oriented vertically. It corresponds to the aforementioned case b), and includes a packaging bottom 4 opposite to a removable lid 6 in the direction of the height 8, parallel to the longitudinal axis 2. In addition to the bottom 4 and lid 6 spaced apart from each other along the axis 2, the packaging 1 includes a lateral body 10 extending around this axis 2. The lateral body 10 extends between a first axial end 10*a* on the lid 6 side, and a second end opposite to the first, situated at the bottom 4 side. The lateral body 10 is thus closed by the lid 6 at a first axial end 10*a*, also referred to as the head end. It is also closed by the bottom 4 at the second axial end 10*b*.

The bottom 4 and the lid 6 delimit axially a housing cavity 12 within which a mass of radioactive materials 13 is received, here a barrel sealingly confining radioactive waste. This type of barrel is also known by the term canister. When this mass 13 is housed in the cavity 12, as shown in FIGS. 1 and 2, it forms with the packaging 1 a parcel 100. The housing cavity 12 is also delimited laterally by the lateral body 10, a specificity of which particular to the invention will now be described.

Internally, this lateral body 10 includes a thickness-change zone 14, which is represented by a transition surface 16 here in the form of a shoulder. The lateral body 10 thus comprises a reduced-thickness part 20*a*, as well as a greater-thickness part 20*b* separated from the part 20*a* by the shoulder 16. The reduced-thickness part 20*a* thus extends from the shoulder 16 towards the first end 10*a*. More precisely, it is delimited axially between this shoulder 16 and the first end 10*a* of the lateral body 10, corresponding to the axial end surface of this body. Moreover, the greater-thickness part 20*b* is delimited axially between the shoulder 16 and the second end 10*b*.

Preferably, the reduced-thickness part 20*a* has a constant thickness. It includes an internal surface 24 laterally delimiting a hollowed-out zone 26 of the lateral body 10, this hollowed-out zone 26 consequently being delimited axially by the transverse surface of the shoulder 16, and by the transverse surface of the first end 10*a* of this body 10. In this preferred embodiment wherein the external surface of the lateral body is cylindrical with a circular cross-section, the internal surface 24 of the reduced-thickness part 20*a* thereof is also preferentially cylindrical with a circular cross-section. Thus the hollowed-out zone 26 is in the form of a cylindrical volume, also with a circular cross-section.

In a similar manner, the greater-thickness part 20*b* also has a constant thickness. It includes an internal surface 28 laterally delimiting the major part of the housing cavity 12, as far as the bottom 4. The internal surface 28 of this greater-thickness part 20*b* is also preferentially cylindrical with a circular cross-section, with a diameter less than that of the internal surface 24 of the reduced-thickness part 20*a* of the lateral body.

One of the other particularities of the invention lies in the presence of a lateral-body reconstitution part 30, which is here in the form a closed ring extending over 360° around the axis 2, in the hollowed-out zone 26. This reconstitution part 30 has an external surface 32 with a form complementary to that of the internal surface 24 of the reduced-thickness part 20*a* of the lateral body. In addition, its internal surface 34 laterally delimits a top part of the housing cavity 12, namely that located above the greater-thickness part 20*b* of the lateral body, that is to say above the shoulder 16. In this regard, it should be noted that the internal surface 34 of the ring 30 has a form identical or similar to that of the internal surface 28 of the greater-thickness part 20*b*, in order to result in a housing cavity 12 with a homogeneous and constant shape. This is because the thickness of the part 20*b* of the lateral body is substantial identical to the total thicknesses of the part 20*a*, and of the ring 30 arranged laterally adjacent to this part 20*a*.

The internal surface 34 and the internal surface 24 are concentric, centred on the axis 2. They are thus spaced apart radially from each other in relation to this axis 2, so as to have a minimum radial separation Emin greater than 30 mm, or more preferentially greater than 50 mm. Through the concentricity of the surfaces 24, 34 and through their shapes, the radial separation between them is preferentially constant or substantially constant throughout the circumferential direction.

In this preferred embodiment, the reconstitution part 30 in the form of a ring forms an integral part of the lid 6. The latter then comprises a main part 36 serving for the axial closure of the housing cavity 12, this main part 36 being preferentially in the form of a slab arranged orthogonally to the axis 2. The lid 6 also includes this reconstitution part 30, arranged projecting axially in the direction of the bottom 4, from an internal surface of the main axial-closure part 36 corresponding to an axial end surface 38 of the cavity. The two components 30, 36 of the lid 6 may be produced in a single piece, or attached fixedly to each other, by welding or by equivalent fixing means. Moreover, the lid 6 could also include an impact damper (not shown) at the axial end surface 38 thereof, so that it is axially opposite the head end of the mass of radioactive materials 13. In a similar manner, such an impact damper could be secured to the mass 13, or simply placed axially between this mass 13 and the lid 6.

As can be seen in FIG. 1, the lid 6, and in particular the main axial-closure part 36 thereof, is entirely covered laterally by the reduced-thickness part 20*a* of the lateral body 10. This makes it possible to reinforce the mechanical strength of the packaging in the event of a lateral or oblique fall, since the lid 6 is perfectly protected by the lateral body. This mechanical strength is also provided by means for fixing the lid 6 on the lateral body 10, which here take the form of a plurality of screwed elements 40 parallel to the axis 2. These elements 40 pass first of all through the periphery of the main axial-closure part 36, and then the reconstitution part 30, in order finally to pass through the shoulder 16 and to come to be screwed in the top end of the part 20*b* of the lateral body. The screwed elements are spaced apart evenly around the axis 2, and the heads thereof are located in countersinks 42 formed on the external surface 44 of the main axial-closure part 36. By virtue of these countersinks 42, the screwed elements 40 do not project from this closure part 36. This makes it possible to assemble a second lid (not shown) on the lateral body 10, over the lid 6, or to make the bottom 45 of an impact-damping cap 46 approach as closely as possible the external surface 44 of the main axial-closure part 36. This cap 46, referred to as a head damper cap, provides in effect a base 45 that delimits a hollow 48 wherein a head portion of the reduced-thickness part 20*a* are housed, as well as the closure part 36 of the lid 6. These two elements are thus covered laterally by the head damper cap 46, it being moreover specified that a similar base-damper cap 50 laterally covers a bottom portion of the greater-thickness part 20*b*, as well as the bottom 4.

The packaging also comprises a sealing system axially gripped between the shoulder 16 and a bottom axial end of the reconstitution part 30. It is a case for example of two seals 54 centred on the axis 2 and arranged at the interface between the aforementioned two elements, inside the fixing crown formed by the screwed elements 40. These seals provide the confinement of the barrel 13 in the housing cavity 12, which then forms a confinement chamber.

With this design particular to the present invention, the cavity 12 is thus delimited axially by the bottom 4 and the main closure portion 36 of the lid, and delimited laterally by the two internal surfaces 34, 28. Moreover, the internal surface 34 of the ring 30 laterally delimits a top axial section of the cavity 12, with a length L1 greater than or equal to 50 mm.

In the loaded configuration of the packaging, and when the lid 6 is fixed on the lateral body 10 as shown in FIG. 1, the reconstitution ring 30 is pressed axially against the shoulder 16, via the screwed elements 40. In this configuration, the shielding is correctly provided at the top part of the lateral body 10, by virtue of its reconstitution of thickness via the ring 30. The top part of the barrel 13 is then located laterally opposite this ring 30, with a preferentially small radial clearance between the two of them. A small axial clearance is also observed between the barrel 13 resting on the bottom 4 in the vertical position in FIG. 1, and the axial-end surface 38 of the main closure part 36 of the lid 6.

After the removal of the lid 6 performed during an operation of discharging the barrel 13, an annular space 56 of the hollowed-out zone 26 is created between the internal surface 24 of the reduced-thickness part 20*a*, and the external surface of a top portion of the barrel 13. The annular space 56 thus has a radial thickness greater than or equal to 30 mm, and preferably greater than or equal to 50 mm.

This annular space 56, visible in FIG. 2 and delimited axially towards the bottom by the shoulder 16, forms a lateral access to the barrel 13 for gripping thereof. This is because a handling device 58 can be introduced axially into this annular space 56 left free and with sufficient radial thickness, in order to be connected to the external lateral surface of the barrel 13. It is a case for example of drum clamps or a grapnel 58, which can be easily inserted in the dedicated space 56, without any need for oversizing the width of the packaging. Once the attachment has been made, the barrel 13 can be extracted axially from the cavity 12.

Figure 4:
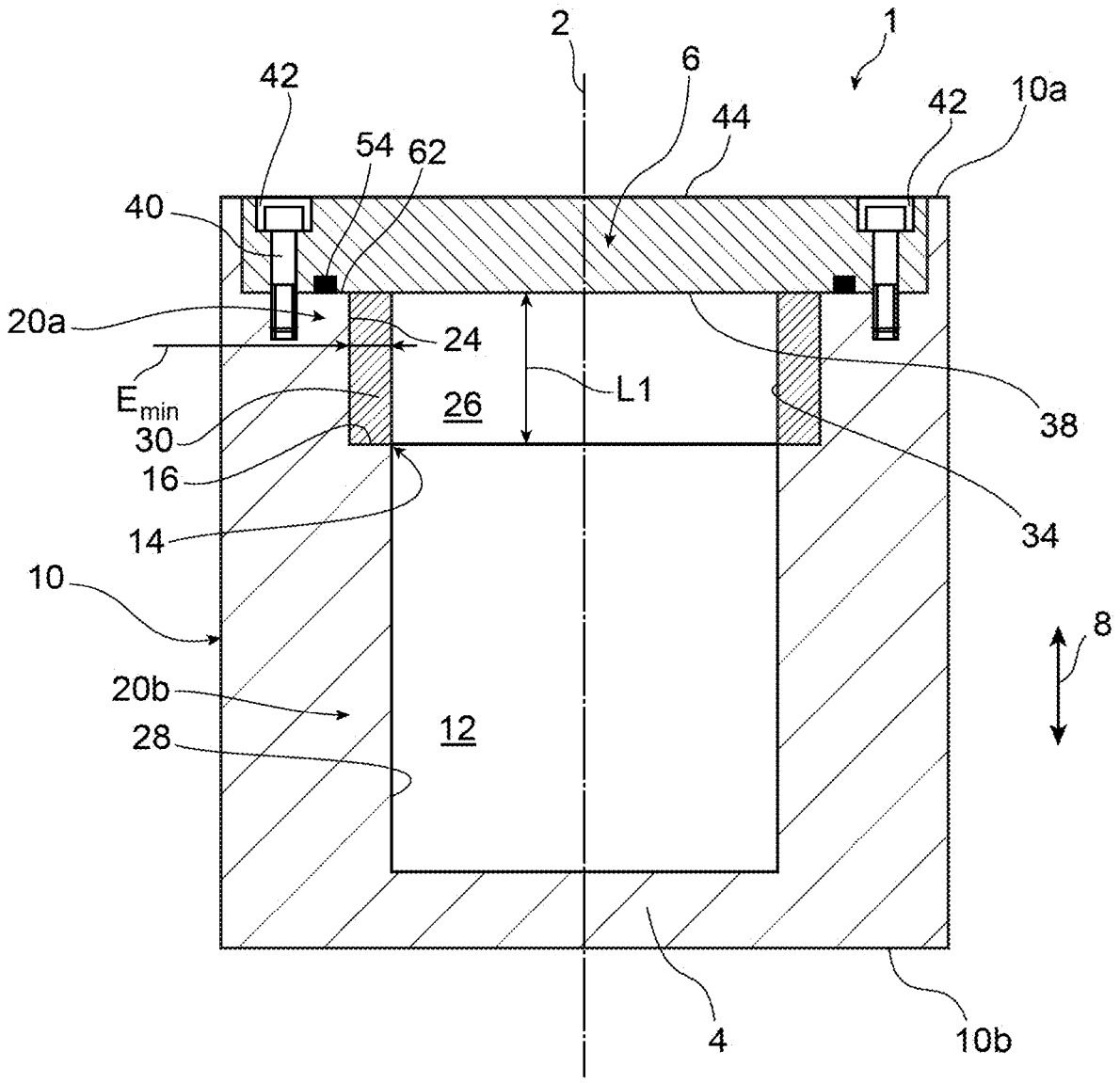
FIG. 4 shows a view similar to the previous one, with the packaging being in the form of another preferred embodiment of the invention.

FIG. 4 shows another preferred embodiment of the invention, having great similarities with the previous embodiment. Moreover, on all the figures, the elements bearing the same numerical references correspond to identical or similar elements.

In this other embodiment corresponding to the aforementioned case a), the main difference lies in the lateral-body reconstitution part, which is no longer a ring integrated in the lid 6, but is a ring 30 independent of the lateral body 10 and of the lid 6. This ring 30 is in fact arranged axially between the lid 6 in the form of a slug, and the shoulder 16 separating the two parts 20*a*, 20*b* of the body 10.

In this embodiment, the seal or seals 54 can be offset between the first end 10*a* of the lateral body 10, and the internal surface of the lid 6 covering this end. As a countersink/recess 62 is preferentially provided at the first end 10*a* in order to receive the lid 6, the seals 54 are thus arranged in the countersink bottom of this first end 10*a*. Likewise, the screwed fixing elements 40 can be arranged here in order to cooperate with the head portion of the reduced-thickness part 20*a*, passing through the periphery of the lid 6 as well as the countersink bottom defined by the first axial end 10*a*.

Finally, in this embodiment, the lid 6 is also entirely covered laterally by the reduced-thickness part 20*a*, being entirely housed in the countersink/recess 62 of the first axial end 10*a*. In the countersink bottom, in the form of a shoulder as for the transition surface 16, the seal 54 is moreover situated inside the fixing crown formed by the screwed elements 40.

Figure 5:
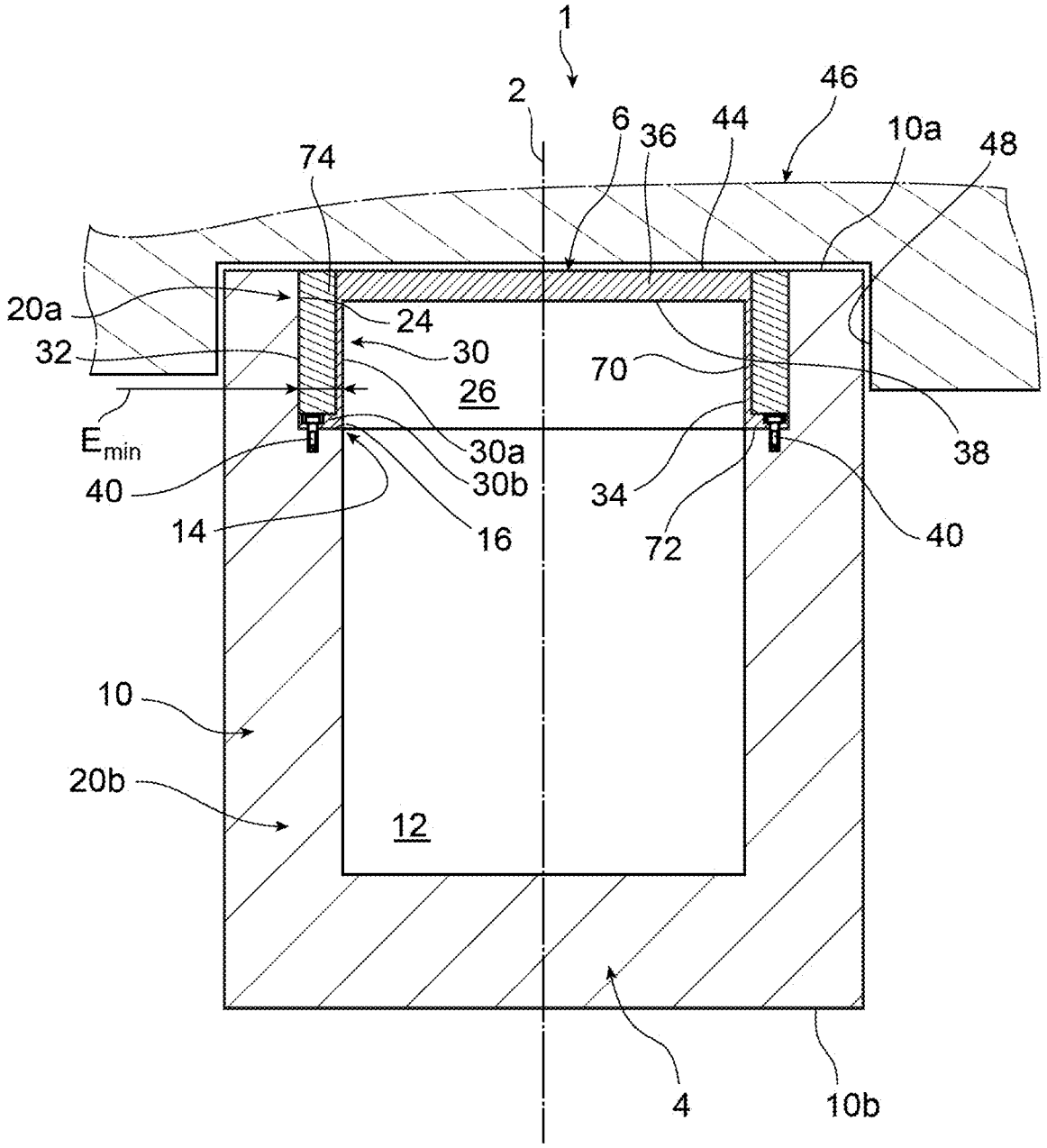
FIG. 5 shows a view similar to the previous ones, with the packaging being in the form of another preferred embodiment of the invention.

FIG. 5 shows yet another embodiment, similar to the previous ones. It corresponds to the aforementioned case c), having the particularity of having a lateral-body reconstitution part 30 formed by two separate elements.

It is a case of a combination of a primary portion 30*a* having great resemblances to the reconstitution part 30 of the embodiment in FIGS. 1 to 3, and a secondary portion 30*b* having great resemblances to the reconstitution part 30 of the embodiment in FIG. 4.

This is because the primary portion 30*a* forms an integral part of the lid 6, which also comprises the main axial-closure part 36 of the housing cavity 12. More precisely, the primary portion 30*a* includes first of all a lateral wall in the form of a thin ring 70, projecting downwards from the axial end surface 38 defined by the main portion 36 of the lid. The ring 70 is centred on the axis 2, and the internal face thereof forms the internal surface 34 radially delimiting the cavity 12. At the axial end thereof opposite to the one connected to the main portion 36, the ring 70 carries fixedly a fixing flange 72. The latter adopts the form of a thin disc centred on the axis 2, projecting radially outwards from the ring 70. The radial extent thereof corresponds substantially to that of the shoulder 16, against which it is intended to come into abutment. To do this, the screwed elements 40 form a crown, each element of which passes through the fixing flange 72, and then the shoulder 16 in order to press these two elements 72, 16 against each other. The length of the screwed elements 40, necessary for fixing the lid 6, thus proves to be particularly small compared with the similar elements in the case b) shown in FIGS. 1 to 3.

If the fixing flange 72 is capable of reconstituting the thickness of the lateral body 10 in the vicinity of the shoulder 16, there remains, after the fixing on the lid 6, an annular space 74 between the internal surface 24 and this same lid. This space is entirely or partially filled in by the secondary portion 30*b* of the reconstitution part 30. This secondary portion 30*b* is independent of the lateral body 10 and of the lid 6, like the reconstitution part 30 of case a) shown in FIG. 4.

It takes the form of another ring 30*b*, one of the axial ends of which is in abutment against the flange 72 axially delimiting the annular space 74, and the other axial end of which is located close to or in the plane of the first end 10*a*, and/or close to or in the plane of the external surface 44 of the main closure part 36. Radially, this ring 30*b* is located between the internal surface 24 and the radially external surface of the assembly formed by the ring 70 of the primary portion 30*a*, and the main part 36 of this lid. In this regard, it should be noted that the main part 36 and the primary portion 30*a* can be produced in a single piece, or more preferentially by assembling a plurality of elements with one another, preferably by welding.

The axial locking of the reconstitution ring 30*b* takes place through the bottom of the head damping cap 46, or by the presence of an additional lid (not shown) axially covering the lid 6 and fixed to the body 10. This additional lid may moreover be provided in all the other embodiments described previously.

Naturally, various modifications can be made by a person skilled in the art to the invention that has just been described, solely by way of non-limitative examples and in accordance with the scope defined by the accompanying claims. In particular, the various preferred embodiments can be combined with one another.

What is claimed is:

1. A packaging for transporting and/or storing radioactive materials, the packaging delimiting a housing cavity intended to receive a mass of radioactive materials, said housing cavity being at least partly defined by a lateral body, a bottom and a lid mounted removably on the lateral body, the bottom and the lid being spaced apart from each other along a longitudinal axis of the packaging, and the lateral body extending between a first axial end on the lid side and a second axial end on the bottom side, wherein the lateral body has a thickness-change zone defining a transition surface, the lateral body comprising a reduced-thickness part extending from the transition surface towards the first axial end of the lateral body, said reduced-thickness part comprising an internal surface laterally delimiting a hollowed-out zone of the lateral body, also delimited axially by the transition surface, wherein the packaging comprises an insert body extending around the longitudinal axis, arranged removably in said hollowed-out zone, and having an internal surface laterally delimiting a part of the housing cavity, and wherein the internal surfaces are spaced apart from each other so as to have a minimum radial separation greater than 30 mm.

2. The packaging according to claim 1, wherein the insert body:

a) is independent of the lateral body and of the lid;

b) forms an integral part of the lid, which also comprises a main part for axial closing off of the housing cavity defining an axial-end surface of said housing cavity, the insert body being arranged projecting axially in the direction of the bottom from the axial-end surface; or c) is formed by combining a primary portion, the primary portion forming an integral part of the lid, which also comprises a main part for axial closing off of the housing cavity defining an axial end surface of said housing cavity, the primary portion including firstly a lateral wall forming the internal surface and arranged projecting axially in the direction of the bottom from the axial end surface, and secondly a fixing flange arranged at an axial end of the lateral wall and configured to be in abutment against the transition surface, the secondary portion being independent of the lateral body and of the lid, and arranged radially between the internal surface of the reduced-thickness part of the lateral body, and the assembly formed by the lateral wall of the primary portion and the main part of said lid.

3. The packaging according to claim 2, further comprising means for fixing the lid on the lateral body, the fixing means passing through the insert body and the transition surface of the lateral body.

4. The packaging according to claim 3, wherein, in case c), said fixing means pass through the fixing flange of the primary portion of the insert body.

5. The packaging according to claim 1, wherein a sealing system is gripped axially between the transition surface of the lateral body and an axial end of the insert body.

6. The packaging according to claim 1, wherein the lid is entirely covered laterally by the reduced-thickness part of the lateral body.

7. The packaging according to claim 1, it further comprising an additional lid fixed to the lateral body.

8. The packaging according to claim 1, further comprising an impact-damping cap covering at least part of the lid, as well as the first axial end of the lateral body.

9. The packaging according to claim 1, wherein the internal surface of the insert body laterally delimits an axial section of the housing cavity, the axial section extending over an axial length greater than or equal to 50 mm.

10. The packaging according to claim 1, wherein the transition surface of the lateral body forms an internal shoulder.

11. A parcel comprising the packaging according to claim 1, loaded with a mass of radioactive materials housed in the housing cavity, the mass of radioactive materials being located partly laterally opposite the insert body.

12. A method for discharging a mass of radioactive materials housed in the housing cavity of the packaging according to claim 1, the method comprising the following steps:

removing the lid and the insert body, so as to release an annular space of the hollowed-out zone between the internal surface of the reduced-thickness part and an external surface of a top portion of the mass;

introducing a handling device into the annular space, in order to connect the handling device to the external surface of the mass; and extracting the mass out of the cavity, by means of the handling device.

13. The parcel according to claim 11, wherein the mass of radioactive materials is in the form of a barrel.

14. The packaging according to claim 1, wherein the insert body is a ring.

* * * * *